US005295846A

United States Patent [19]

Sumida et al.

[11] Patent Number: 5,295,846

[45] Date of Patent: Mar. 22, 1994

[54] PLUG-IN CONNECTOR ASSEMBLY

[75] Inventors: Tatsuya Sumida; Yasuo Matsushita, both of Yokkaichi, Japan

[73] Assignee: Sumitomo Wiring Systems, Ltd., Mie, Japan

[21] Appl. No.: 989,580

[22] Filed: Dec. 11, 1992

[30] Foreign Application Priority Data

Jan. 10, 1992 [JP] Japan ..... 4-003171

[51] Int. Cl.[5] ..... H01R 29/00

[52] U.S. Cl. ..... 439/188; 200/51.1

[58] Field of Search ..... 439/188, 592, 595, 511-513; 200/51 R, 51.09, 51.1

[56] References Cited

U.S. PATENT DOCUMENTS

| | | | |
|---|---|---|---|
| 4,224,486 | 9/1980 | Zimmerman, Jr. et al. | 439/188 X |
| 4,786,258 | 11/1988 | Shaffer et al. | 439/188 |
| 4,850,888 | 7/1989 | Denlinger et al. | 439/188 |
| 4,904,196 | 2/1990 | Sueyoshi et al. . | |
| 4,954,093 | 9/1990 | Nadin | 439/188 |
| 4,973,268 | 11/1990 | Smith et al. | 439/595 |

FOREIGN PATENT DOCUMENTS

| | | |
|---|---|---|
| 64-41989 | 3/1989 | Japan . |
| 1-77287 | 5/1989 | Japan . |

*Primary Examiner*—Larry I. Schwartz

*Assistant Examiner*—Khiem Nguyen

*Attorney, Agent, or Firm*—Sughrue, Mion, Zinn, Macpeak & Seas

[57] ABSTRACT

An electric connector assembly comprising plug and socket connectors adapted to be connected together. The socket connector includes a socket connector housing having an end portion adapted to be received within the receptacle in the plug connector housing and also having parallel passageways defined therein so as to open outwardly from the end portion thereof. Each passageway accommodates therein a socket terminal member. A retainer is releasably mounted on the end portion of the socket connector housing. This retainer carries at least one contact bridge member engageable with the socket terminal members to establish an electric circuit between the socket terminal members when the socket terminal members have been inserted completely into the passageways and the retainer has been completely mounted on the end portion of the socket connector housing. The plug connector housing having the receptacle defined therein may have an actuator member operable in response to an insertion of the end portion of the socket connector housing into the receptacle to disengage the contact bridge member from the socket terminal members thereby to open an electric circuit between the socket terminal members.

13 Claims, 5 Drawing Sheets

PLUG-IN CONNECTOR ASSEMBLY

BACKGROUND OF THE INVENTION

1. Field of the Invention

The present invention generally relates to a harness connector assembly comprising plug and socket connectors adapted to be electrically connected together in a plug-in fashion. More particularly, the present invention relates to one of the plug and socket connectors of a type wherein at least one pair of electrical contacts are short-circuited by means of a contact bridge before use, that is, before the other of the plug and socket connectors is inserted into such one of the plug and socket connectors to establish an electrical connection therebetween.

2. Description of the Prior Art

In an automobile, for example, electric wires used to distribute electric power among numerous electrically operated devices are bound together into harnesses. Those electric wires bound together into the harnesses are generally known as wiring harnesses and are generally marked by means of colors for identification purpose. The electric wires forming the wiring harness may lead out from an electrically operated device and terminate in a terminal connector, for example, a plug connector for connection with an electrical power source or a different electrically operated device through another similar wiring harness having a mating terminal connector, that is, a socket connector, at its opposite ends.

To establish an electrical harness-to-harness connection, it is a general practice to employ a plug-in connector assembly comprising a plug connector having a plurality of terminal pins and a socket connector having a corresponding number of terminal sockets for receiving the terminal pins. Of the variety of plug-in connector assemblies now in use, there is known a plug-in connector assembly of a design wherein one of the plug and socket connectors has at least one pair of the electrical contacts short-circuited by means of a contact bridge before use. In this design, the contact bridge short-circuited the electrical contacts in one connector is released, when the other connector is inserted into such one connector, to isolate the electrical contacts from each other while allowing them to be electrically connected with associated electrical contacts in the other connector. The plug-in connector assembly of the above discussed design is generally used in, inter alia, an automobile security circuit associated with a security air bag for inflating the air bag in the event of an automobile accident.

For example, the Japanese Laid-open Utility Model Publications No. 64-41989, published Mar. 13, 1989, and No. 1-77287, published May 24, 1989, reproduced in FIGS. 10 and 11 of the accompanying drawings, respectively, disclose the socket connector including two electrical contacts short-circuited by a releasable contact bridge within a socket housing.

More specifically, the plug-in connector assembly disclosed in the first mentioned publication No. 64-41989 and reproduced in FIG. 10 comprises a socket connector including two generally tubular socket contacts 5 within a generally rectangular socket housing 1, and a plug connector including an equal number of elongated plug contacts 6 within an openended plug housing 2 adapted to receive therein the socket housing 1 with the plug contacts 6 plugged into the socket contacts 5. As shown therein, each of the socket contacts 5 has an elastically yieldable tongue 8 formed integrally therewith so as to extend in a direction counter to the direction of insertion of the socket contacts 5 into the socket housing 1. A generally rectangular contact bridge 4 is secured to an inner surface of a top wall of the socket housing 1 so as to lie in a direction perpendicular to the direction of insertion of the socket contacts 5 into the socket housing 1 and also to the longitudinal axes of the socket contacts 5.

In assembling the socket connector, the socket contacts 5 are press-fitted into the socket housing 1 one at a time so as to extend parallel to each other. At this time, the elastically yieldable tongues 8 are, during the insertion of the socket contact 5 into the socket housing 1, elastically yielded inwardly while accumulating an outwardly acting elastic force, and then expand outwardly upon completion of the insertion by the action of the accumulated outwardly acting elastic force. In an assembled condition shown in FIG. 10, the elastically yieldable tongues 8 are held in contact with the contact bridge 4 thereby to establish an electric circuit between the socket contacts 5 within the socket housing 1.

The electric circuit between the socket contacts 5 can be opened when the plug contacts 6 within the plug connector are inserted into the socket contacts 5 with the socket housing 1 received within the plug housing 2. This is possible because, as the plug contacts 6 are inserted into the socket contacts 5, the elastically yieldable tongues 8, then expanded outwardly to engage the contact bridge 4, are inwardly yielded in contact with the plug contacts 6 to disengage from the contact bridge 4.

The plug-in connector assembly shown in FIG. 10 may work satisfactory in the electric circuit in which it is installed. However, the assemblage requires enough complicated and time-consuming procedures to make the plug-in connector assembly expensive to manufacture. Specifically, when the socket contacts 5 are inserted into the socket housing 1, the accumulated outwardly acting elastic force of each of the tongues 8 hampers a smooth insertion of the respective socket contact 5 into the socket housing 1. Therefore, it often occurs that the socket contact 5 is inserted halfway within the socket housing 1, and this is particularly true where the socket housing 1 has protuberances protruding into passageways through which the socket contacts 5 are inserted one at a time.

Also, before the socket contacts 5 are inserted into the socket housing 1, each tongue 8 remains outwardly protruding from the body of the associated socket contact and, therefore, it may often occur that the tongue 8 is detrimentally deformed during a transportation of the socket contacts before the assemblage or during the insertion thereof into the socket housing 1. In addition, because of the unique shape of each socket contact 5, the use thereof is exclusively limited to the particular type of plug-in connector assembly, thereby lacking a versatility.

Moreover, in order for the contact bridge 4 to be properly positioned within the socket housing 1, either the insert-molding process or the press-fitting technique has to be adopted to place the contact bridge 5 in position within the socket housing 1 and this leads to a reduction in work efficiency in installing the contact bridge 5.

On the other hand, the second mentioned publication No. 1-77287 discloses, as shown in FIG. 11, the use of the bridge contact 4 of a design having a pair of elastically yieldable, curled tongues 4a formed integrally therewith, instead of the elastic tongues 8 integral with the socket contacts 5 shown in FIG. 10. The contact bridge 4 is secured to an inner surface of a top wall of the socket housing 1 with the curled tongues 4a held in position ready to contact the socket contacts 5 when the latter are completely inserted into the socket housing 1.

The curled tongues 4a integral with the contact bridge 4 is cooperable with a generally rectangular insulating plate 7 disposed within or formed integrally with the plug housing 2 so as to lie above the elongated plug contacts 6 and at a location where, when the socket housing 1 is inserted into the plug housing 2 with the plug contacts 6 received within the respective socket contacts 5, the insulating plate is wedged in between the curled tongues 4a and the socket contacts 5 to separate the curled tongues 4a away from the socket contacts 5.

The socket connector shown in FIG. 11 has problems similar to those discussed in connection with the socket connector shown in FIG. 10.

SUMMARY OF THE INVENTION

The present invention has been devised with a view to substantially eliminating the above discussed problems inherent in the prior art plug-in connector assemblies and is intended to provide an improved plug-in connector assembly wherein a resistance to an insertion of each of the terminal members into a housing is minimized to avoid any possibility that the terminal member may be inserted halfway within the housing and wherein means is provided to detect a halfway insertion of any one of the terminal members within the housing.

To this end, the present invention provides an electric connector assembly comprising plug and socket connectors adapted to be connected together. The socket connector includes a socket connector housing having an end portion adapted to be received within the receptacle in the plug connector housing and also having parallel passageways defined therein so as to open outwardly from the end portion thereof. Each passageway accommodates therein a socket terminal member. A retainer is releasably mounted on the end portion of the socket connector housing. This retainer carries at least one contact bridge member engageable with the socket terminal members to establish an electric circuit between the socket terminal members when the socket terminal members have been inserted completely into the passageways and the retainer has been completely mounted on the end portion of the socket connector housing.

The plug connector housing having the receptacle defined therein may have an actuator member operable in response to an insertion of the end portion of the socket connector housing into the receptacle to disengage the contact bridge member from the socket terminal members thereby to open an electric circuit between the socket terminal members.

Preferably, the end portion of the socket connector housing is of a generally rectangular cross-sectional shape and the retainer is of a generally cap-like configuration having a cross-section oversized relative to the end portion of the socket connector housing so that the retainer can be capped onto the end portion. Means is provided for temporarily holding the retainer at a temporary mounting position on the end portion.

The plug connector housing may have two other plug terminal members than those adapted to be connected with the socket terminal members. These two other plug terminal members partly protrude into the receptacle and are adapted to be electrically connected together by means of a second contact bridge member mounted on the retainer. For this purpose, the plug connector housing has a second actuator member carried thereby and operable to drive the second contact bridge member to engage the two other plug terminal members to establish an electric circuit between them when the socket and plug connector housings are coupled together with the end portion inserted into the receptacle.

According to the present invention, the use of the contact bridge member separate from the socket housing permits the socket terminals to be smoothly inserted into the passageways with no resistance imposed on the insertion of the socket terminal members. This is true even when the contact bridge member is mounted on the end portion, of the socket connector housing, but is retained at the temporary mounting position. Only when the contact bridge member is moved from the temporary mounting position to a completely mounted position, the socket terminal members are electrically connected together to establish the circuit therebetween.

Moreover, the use of the retainer carrying the contact bridge member eliminates the use of the insert-molding technique hitherto required in the prior art assembly, thereby making it easy to manufacture the assembly.

Furthermore, the present invention is effective to provide a freedom of choice of selection of the socket and/or plug terminal members which are to be or not to be short-circuited with each other.

BRIEF DESCRIPTION OF THE DRAWINGS

This and other objects and features of the present invention will become clear from the following description taken in conjunction with preferred embodiments thereof with reference to the accompanying drawings, in which like parts are designated by like reference numerals and in which.

DETAILED DESCRIPTION OF THE EMBODIMENT

Referring to FIGS. 1 to 8, and particularly to FIGS. 1 to 5, a plug-in connector assembly embodying the present invention comprises a socket connector and a plug connector adapted to be connected together to establish an electric circuit therebetween. The socket connector includes a generally rectangular socket housing 10 comprised of top and bottom walls, a front end wall 10*a* and a pair of side walls, and a generally rectangular sectioned retainer 12 adapted to be mounted on the socket housing 10 as will be described later.

Figure 4:
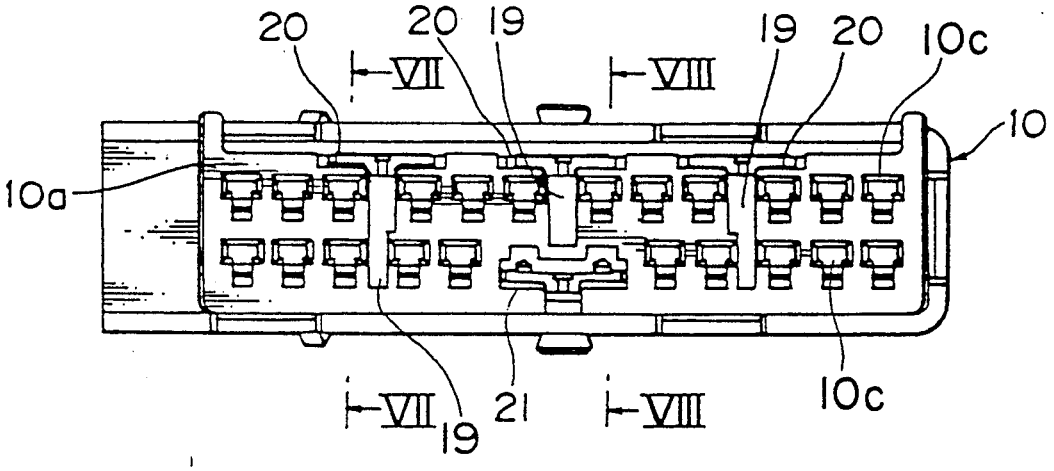
FIGS. 4 and 5 are front elevational views of socket and plug housings, respectively, which form parts of the plug-in connector assembly of the present invention.
Figure 5:
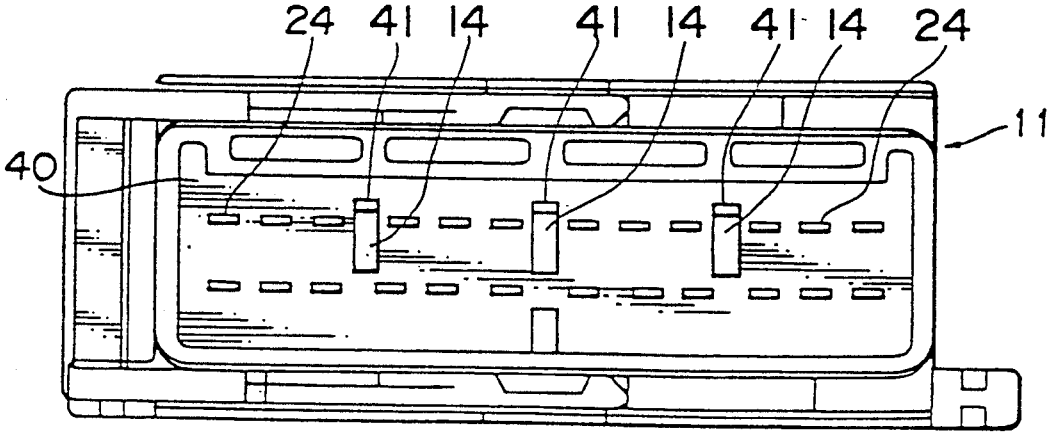

The socket housing 10 has a plurality of spaced, parallel passageways 15 defined therein so as to extend from a rear face to the front end 10*a* and arranged in a plurality of rows, for example, in upper and lower rows as can be understood from FIG. 4. Each passageway 15 is separated from adjacent passageways 15 by side walls and the upper and lower rows are separated by an intermediate transverse wall 10*b*. These passageways 15 accommodate therein a corresponding number of socket terminals 16 each having a rear end connected with a suitable harness wiring and a front end exposed to the outside through a generally T-shaped window 10*c* defined in the front end wall 10*a* of the socket housing in communication with the associated passageway 15.

On the other hand, the plug connector includes a generally rectangular plug housing 11 having a receptacle recess 40 adapted to receive therein the socket connector and also having a plurality of elongated plug terminals 24 retained in position in any known manner in the plug housing 11 while partly protruding into the receptacle recess 40. As a matter of design, the plug terminals 24 are arranged in upper and lower rows and in a pattern similar to the pattern of the socket terminals 16 of the upper and lower rows so that, when the socket and plug connectors are connected together, the plug terminals 24 can be plugged into the associated socket terminals 16. It is, however, to be noted that the number of the socket terminals 16 in each or both rows may not be always equal to that of the plug terminals 24 in the corresponding row or rows.

In the illustrated instance, the end wall 10*a* is shown to have the twelve T-shaped windows 10*c* defined therein in each of upper and lower rows in communication with the associated row of the passageways 15 as best shown in FIG. 4. For the description of the present invention, it is assumed that three pairs of the passageways 15 in the upper row are to accommodate corresponding pairs of the socket terminals 16 which are electrically short-circuited by means of respective contact bridges 13 of identical construction and that one pair of the passageways 15 in the lower row are left blank, but are to accommodate a corresponding pair of the plug terminals 24 which are to be short-circuited with each other by means of an associated contact bridge 13 when the plug connector and the socket connector are coupled together. The contact bridges 13, the details of which will subsequently be described, are carried by the retainer 12 and are then placed in position relative to the socket housing 10 when the retainer 12 is mounted onto the socket housing 10.

The retainer 12 is of a generally rectangular cap-like configuration and includes a generally rectangular peripheral wall 12*a* having top, bottom and side wall portions, an end wall 12*b* and a generally comb-shaped intermediate partition wall 12*c* corresponding in position to and parallel to the intermediate transverse wall 10*b* of the socket housing 10. This retainer 12 includes four contact bridges 13 of identical construction detachably mounted on the peripheral wall 12*a*. Of them, the three contact bridges 13 are mounted on the retainer 12 at respective locations corresponding to the three pairs of the passageways 15 in the upper row that accommodate therein the corresponding pairs of the socket terminals 16 to be short-circuited, and one contact bridge 13 is mounted on the retainer 12 at a location corresponding to the pair of the passageways 15 in the lower row that are adapted to accommodate therein the pair of the plug terminals 24 to be short-circuited with each other.

Figure 3A:
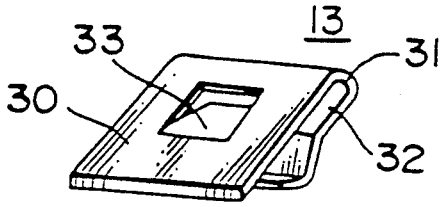
FIGS. 3(A) and 3(B) are schematic perspective views of a contact bridge employed in the plug-in connector assembly of the present invention as viewed from top and bottom, respectively.
Figure 3B:
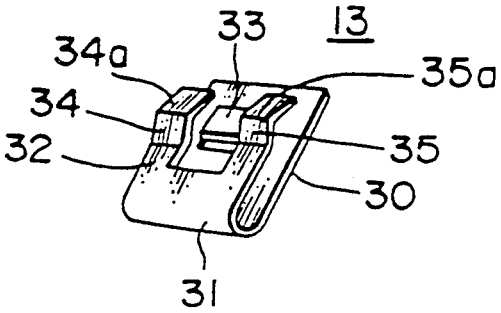

As best shown in FIGS. 3(A) and 3(B), each of the contact bridges 13 is of one-piece construction made of electroconductive material, for example, metal, and is in the form of a generally U-sectioned clip having a generally rectangular flat body 30 and a turnback body 31 continued from one end of the flat body 30 so as to extend beneath the flat body 30 and towards the opposite end of the flat body 30, said turnback body 31 having a pair of elastic fingers 34 and 35. Each of the elastic fingers 34 and 35 is bent at 34*a* or 35*a* so as to protrude outwardly from the flat body 30 to ensure a firm contact between the respective finger 34 or 35 and the associated socket or plug terminal as will be described later. A generally central portion of the flat body 30 is slitted to define an elastically yieldable anchor plate 33 that is oriented slantwise in a direction counter to the direction of insertion of the respective contact bridge 13 onto the retainer 12.

Each of the contact bridges 13 of the above described construction is mounted on the retainer 12 with a respective portion of the peripheral wall 12*a* received in a generally U-shaped groove that is defined between the flat and turnback bodies 30 and 31. With the respective contact bridge 13 so mounted on the retainer 12, the associated anchor plate 33 urges that portion of the peripheral wall 12*a* of the retainer 12 against the turnback body 31 thereby to lock the contact bridge 13 as a whole in position on the retainer 12, resisting against any possible pull of the contact bridge 13 in a direction away from the retainer 12.

The end wall 12*b* of the retainer 12 has generally T-shaped openings 23 defined therein in a pattern identical with the pattern of the passageways 15 in the socket housing 10 for the passage of the plug terminals 24 therethrough into the associated passageways 15 in the socket housing 10.

The retainer 12 carrying the contact bridges 13 is capped onto the socket housing 10 after the individual socket terminals 16 have been completely inserted into the associated passageways 15 in the socket housing 10. This retainer 12 serves not only to carry the contact bridges 13 in the manner described above, but also to detect whether one or some of the socket terminals 16 are inserted into the respective passageways 15 in the wrong way, that is, inserted substantially halfway in the respective passageways 15, and to lock the individual socket terminals 16 in position inside the associated passageways 15 both during the assembly of the socket connector. The capabilities of the retainer 12 to detect the halfway insertion of one or some of the socket terminals 16 into the respective passageways 15 and also to lock the socket terminals 16 in position inside the passageways 15 will now be described.

As clearly shown, each of the socket terminals 16 has a lance or protuberance 25 protruding laterally outwardly thereof with respect to the longitudinal axis thereof. This protuberance 25 is, when and after the respective socket terminal 16 is completely inserted into the associated passageway 15, engaged in a detent recess 50*a* in an elastically yieldable finger 50 which is integrally formed with the intermediate transverse wall 10*b* or the bottom wall of the socket housing 10 for each of the passageways 15. Specifically, during the insertion of the respective socket terminal 16 into the associated passageway 15, the protuberance 25 slides over an eaves 50*b* that protrudes from the elastically yieldable finger 50 into the associated passageway 15, while urging the elastically yieldable finger 50 against the resiliency thereof. As soon as the protuberance 25 slides completely over the eaves 50*b*, the protuberance 25 is caught into the detent recess 50*a* while the elastically yieldable finger 50 restores to its original shape having been biased by its own resiliency. In this way, each of the socket terminals 16 is non-detachably retained in the associated passageway 15.

However, in the event that the socket terminal 16 is inserted in the associated passageway 15 in the wrong way, that is, generally halfway in the associated passage 15, during the assembly of the socket connector with the protuberance 25 consequently resting on the eaves 50*b* of the associated finger 50, the associated finger 50 remains urged against its own resiliency so as to diverge away from the socket terminal 15 then inserted halfway.

The intermediate partition wall 12*c* integral with the retainer 12 has a transverse row of prongs 26 formed integrally therewith so as to extend outwardly therefrom towards the front end face 10*a* of the socket housing 10 and so as to align with the upper row of the passageways 15 in the socket housing 10. Similarly, the bottom wall portion of the peripheral wall 12*a* of the retainer 12 has a transverse row of prongs 26 formed integrally therewith so as to extend outwardly therefrom towards the front end face 10*a* and so as to align with the lower row of the passageways 15 in the socket housing 10.

Therefore, in the event that one of the socket terminals 16 remains inserted halfway within the associated passageway 15 in the socket housing 10, and when the retainer 12 is subsequently capped onto the front end of the socket housing 10 with the prongs 26 creeping into the associated passageways along the intermediate transverse wall 10*b* and a bottom wall portion of the socket housing 10, one of the prongs 26 aligned with one of such associated passageway 15 in which the socket terminal 16 is left inserted halfway is brought into abutment with the tip of the elastically yieldable finger 50 in such associated passageway 15, thereby resisting to a further mounting of the retainer 12 onto the socket housing 10. This is possible because, as discussed hereinabove, when and so long as any one of the socket terminals 16 is inserted halfway within the associated passageway 15, the elastically yieldable finger 50 in such associated passageway 15 remains deformed against its own resiliency so as to protrude into the path of movement of the corresponding prong 26.

Thus, once at least one of the prongs 26 is brought into abutment with the tip of a corresponding one of the elastically yieldable fingers 50, the retainer 12 is no longer capped further onto the socket housing 10, thereby providing an indication that somewhere in the passageways 15 at least one socket terminal 16 is left inserted in the wrong way.

Figure 6:
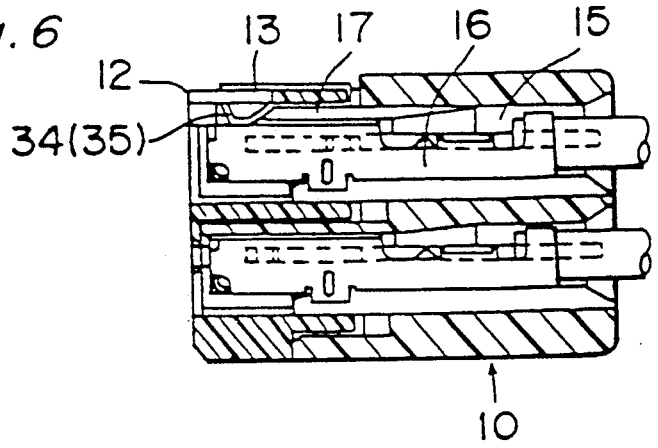
FIG 6 is a longitudinal sectional view of the socket housing having a retainer completely inserted onto the socket housing.

The prongs 26 rigid or integral with the retainer 12 serve not only to detect whether or not at least one of the socket terminales 16 is inserted in the wrong way within the associated passageway 15, but also to ensure a firm locking of the socket terminals 16 in position within the respective passageways 15. FIGS. 6 to 8 showing a condition in which the retainer 12 has been completely capped onto the socket housing 10 while the socket terminals 16 have also been completely inserted into the respective passageways 15. As clearly shown therein, the prongs 26 are inserted beneath the protuberances 25 integral with the respective socket terminals 16 with the associated elastically yieldable fingers 50 sandwiched therebetween. While the elastically yieldable fingers 50 themselves are effective to retain the socket terminals 16 in position inside the associated passageways 15 with the protuberances 25 engaged in the detent recesses 50*a*, the prongs 26 in the condition as shown in any one of FIGS. 6 to 8 serve effectively to avoid any possible deformation of the elastically yieldable fingers 50 which would otherwise permit a removal or separation of the socket terminals 16 out of the associated passageways 15.

Figure 1:
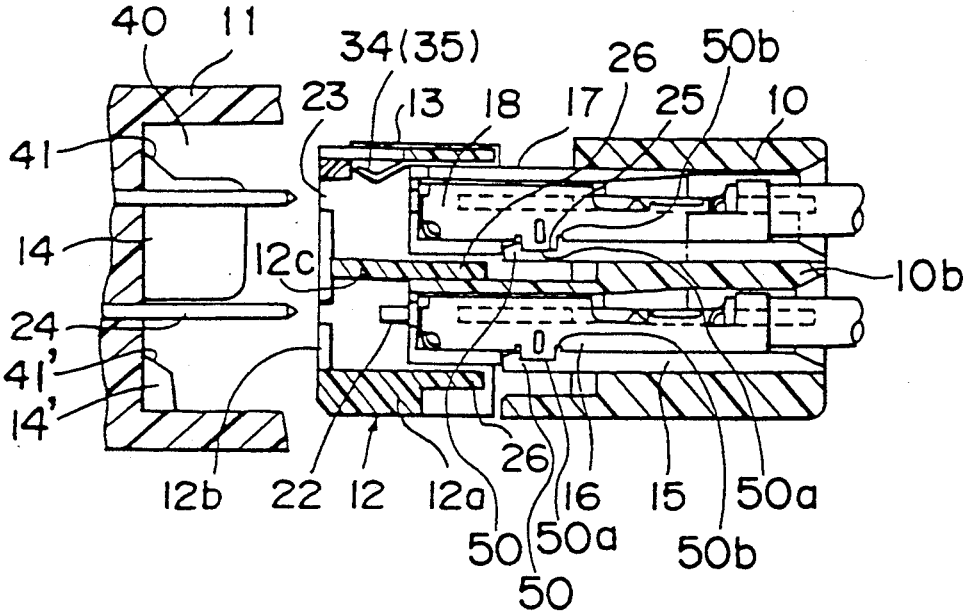
FIG. 1 is a schematic longitudinal sectional view of a plug-in connector assembly according to the present invention.

Although not essential in the practice of the present invention, means is provided for temporarily retaining the retainer 12 in position mounted generally halfway on the socket housing 10. For this purpose, opposite side walls of the socket housing 10 are formed with respective detent sockets while opposite side wall portions of the peripheral wall 12*a* of the retainer 12 are formed with corresponding detent projections 22 (FIG. 1) that protrude inwardly of the retainer 12 for releasable engagement into the detent sockets in the side walls of the socket housing 10. Thus, it will readily be understood that, during the capping of the retainer 12 onto the front end portion of the socket housing 10, the detent projections 22 are clicked into the respective detent sockets by the utilization of the elasticity of each of the side wall portions of the peripheral wall 12*a* of the retainer 12, thereby retaining the retainer 12 in a position mounted generally halfway on the socket housing 12 as shown in FIG. 1. A further push applied to the retainer 12 in a direction close towards the socket housing 10 or to the socket housing 10 in a direction close towards the retainer 12 permits the detent projections 22 to disengage from the detent sockets whereby the retainer 12 can be further capped onto the socket housing 10 to assume a completely mounted position as shown in any one of FIGS. 6 to 8.

Referring again to FIG. 2, with the contact bridges 13 mounted in position on the retainer 12, the retainer 12 is formed with a generally U-shaped slit 27 while leaving an elastically yieldable operating piece 28. As best shown therein, the U-shaped slit 27 in the retainer 12 has its opposite ends terminating at a position spaced a distance inwardly from a free end edge of the peripheral wall 12*a* thereof and a generally intermediate portion defined in the end wall 12*b* adjacent a joint between it and the peripheral wall 12*a*. Therefore, each operating piece 28 carrying the corresponding contact bridge 13 is elastically yieldable when a force is applied to a portion of the operating piece 28 adjacent the end wall 12*b*, the function of which will be described in detail later.

As hereinbefore discussed, each contact bridge 13 is used to electrically connect two of the socket terminals 16 with each other when the retainer 12 is completely mounted on the socket housing 10 as best shown in FIG. 6. For this purpose, wall portions of the socket housing 10 aligned with each pair of the passageways 15 where the socket terminals 16 to be short-circuited with each other are inserted is formed with access openings 17. These access openings 17 permit the contact areas 34*a* and 35*a* of the associated fingers 34 and 35 of the corresponding contact bridge 13 to protrude therethrough into the respective passageways 15 to electrically connect the socket terminals 16 together, when the retainer 12 is completely mounted on the socket housing 10. It is, however, to be noted that, so long as the retainer 12 is retained at the temporarily mounted position with the detent projections 22 engaged in the detent sockets, that is, mounted generally halfway on the socket housing 10 as shown in FIG. 1, the contact areas 34*a* and 35*a* of the respective fingers 34 and 35 are situated outside the socket housing 10 without being engaged in the associated access openings 17 so that the socket terminals 16 can be smoothly inserted into the corresponding passageways 15.

In order for a top surface, i.e., an outer surface of the flat body 30, of each contact bridge 13 mounted on the retainer 12 to be substantially level with an outer surface of the top wall of the socket housing 10 when the retainer 12 is completely capped onto the socket housing 10, a portion of the top wall of the socket housing around the access openings 17 are inwardly recessed as indicated by 20 for receiving therein the turnback body 31 that protrudes inwardly of the retainer 12. It is to be noted that, when and so long as the retainer 12 capped halfway onto the socket housing 10 is held at a temporarily retained position as shown in FIG. 1, the fingers 34 and 35 of each contact bridge 13 are positioned outwardly of the socket housing 10 as shown in FIG. 1.

Figure 2:
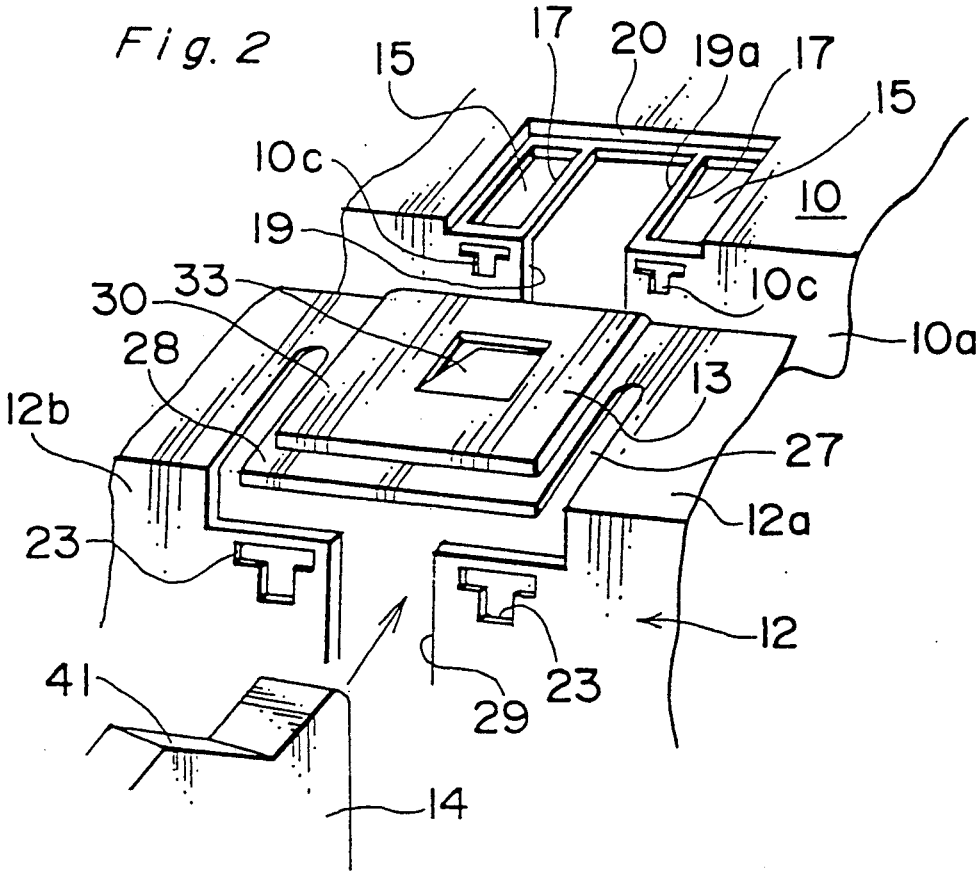
FIG. 2 is an exploded view, on a somewhat enlarged scale, of a portion of the plug-in connector assembly shown in FIG. 1.

As best shown in FIGS. 2 and 4, the front end wall 10*a* of the socket housing 10 is formed with vertical access slots 19 each defined between the generally T-shaped windows 10*c* of a corresponding pair that are associated with the socket terminals 16 to be short-circuited with each other by means of the respective contact bridge 13. Each access slot 19 is communicated with a cutout 19*a* defined in the top wall of the socket housing 10 at a location intermediate between the T-shaped windows 10*c* of that pair. As will become clear from the subsequent description, each access slot 19 communicated with the respective cutout 19*a* is adapted to accommodate a corresponding actuator rib 14 formed integrally or rigidly with the plug housing 11.

In alignment with the access slots 19, similar access slots 29 are formed in the end wall 12*b* of the retainer 12 so as to occupy respective positions intermediate between the T-shaped openings 23 of the associated pairs for the passage therethrough of the corresponding actuator ribs 14. Each of the access slots 29 in the end wall 12*b* of the retainer 12 is communicated at one end with the intermediate portion of the adjacent slit 27 as best shown in FIG. 2.

As best shown in FIG. 4, the front end wall 10*a* of the socket housing 10 also has a vertical access slot 21 defined therein immediately below an intermediate one of the vertical access slots 19. This access slot 21 is similar, but inverted, in shape to any one of the access slots 29 and is associated with one of the contact bridges 13 which is used to short-circuit the pair of the plug terminals 24, not the pair of the socket terminals 16, as will be described later with particular reference to FIG. 8. Although not shown, an access slot similar in shape to the access slot 21 in the front end wall 10*a* of the socket housing 10 is also formed in the end wall 12*b* of the retainer 12 in alignment with the access slot 21.

Figure 7A:
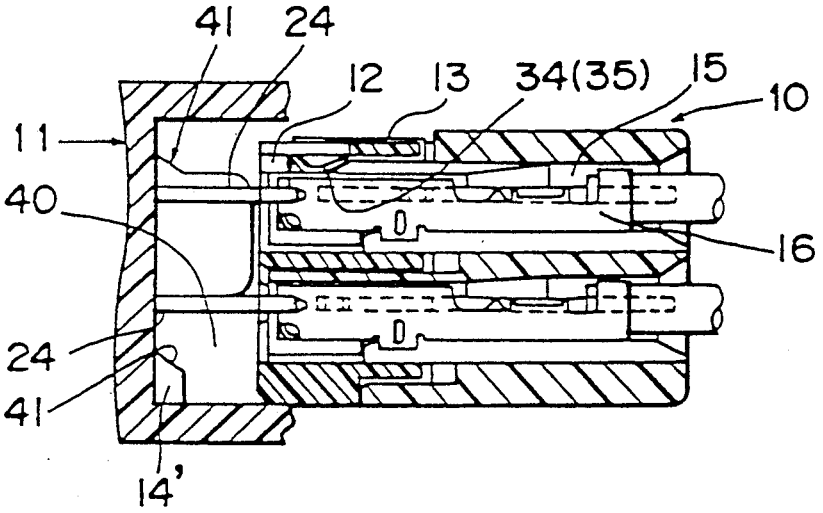
FIGS. 7(A) and 7(B) are cross-sectional views taken along the line VII—VII in FIG. 4, showing the socket housing before and after it is received in the plug housing, respectively.
Figure 7B:
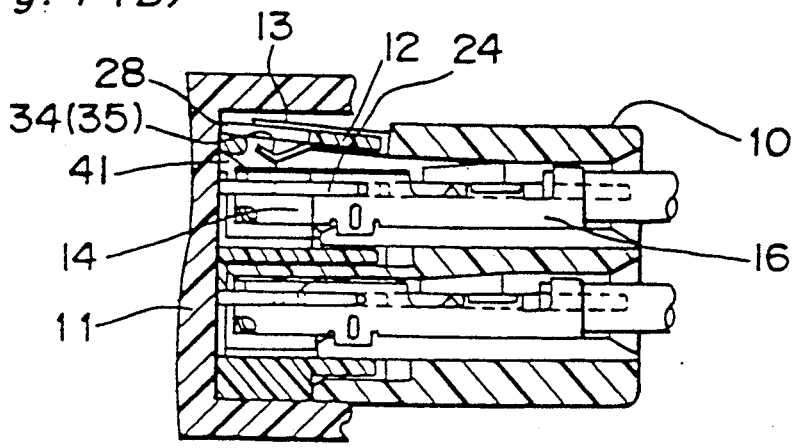

So far as the three pairs of the socket terminals 16 which are electrically short-circuited with each other by means of the corresponding contact bridges 13 on the retainer 12 are concerned, the socket terminals 16 of each pair can be isolated from each other automatically when the plug housing 11 is capped onto the socket housing 10 while the retainer 12 has been completely capped onto the socket housing 10. For this purpose, the actuator rib 14 formed in the plug housing 11 for each pair of the short-circuited socket terminals 16 has a riser 41 integrally formed therewith. Therefore, assuming that the retainer 12 has been completely mounted on the socket housing 10 as shown in FIG. 7(A) thereby to complete the socket connector, and as the socket connector is coupled with the plug connector with the retainer 12 progressively inserted into the receptacle recess 40 in the plug housing 11, the actuator ribs 14 enter deep into the socket connector through the access slot 29 and then through the access slot 19. Further insertion of the actuator ribs 14 causes the associated operating pieces 28 in the retainer 12 to be upwardly shifted against their own resiliency in contact with the risers 41 and, finally, the contact areas 34*a* and 35*a* of the respective contact bridges 13 are consequently disengaged from the socket terminals 16 of the associated pairs as shown in FIG. 7(B). This is possible because the U-shaped slit 27 leaving the respective operating piece 28 in the peripheral wall 12*a* of the retainer 12 allows the operating piece 28 to deform together with the corresponding contact bridge 13 as the riser 41 enters the access slot 29 while pushing the operating piece 28 upwardly in sliding contact therewith.

Figure 8A:
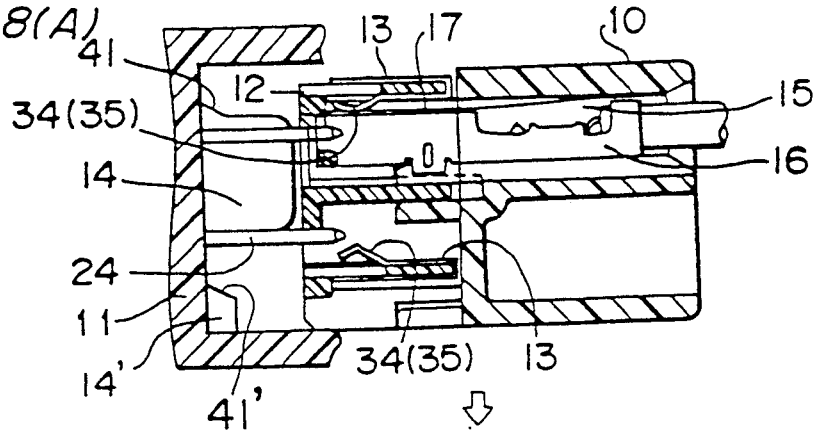
FIGS. 8(A) and 8(B) are cross-sectional views taken along the line VIII—VIII in FIG. 4, showing the socket housing before and after it is received in the plug housing, respectively.
Figure 8B:
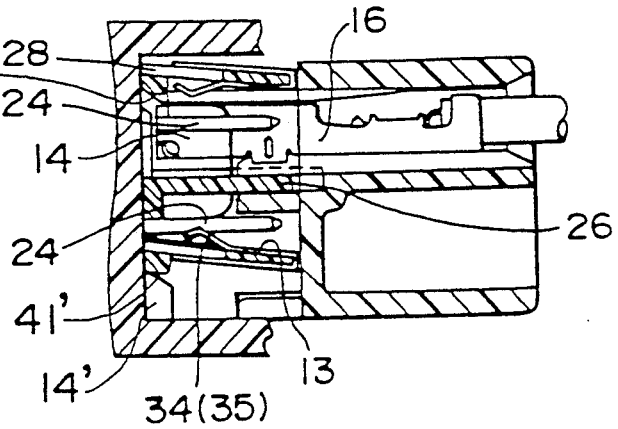

Referring particularly to FIGS. 8(A) and 8(B) which illustrate cross-sections taken along the lines and VIII—VIII in FIG. 4, there is specifically shown how the pair of the plug terminals 24 are short-circuited with each other by means of the corresponding contact bridge 13 when the plug connector is completely coupled with the socket connector. In this example, no socket terminal is inserted in the pair of the passageways 15 in the lower row which are aligned with the pair of the plug terminals 24 to be short-circuited with each other.

In the example shown in FIGS. 8(A) and 8(B), as the socket connector is inserted into the receptacle recess 40 in the plug housing 11, the actuator rib 14' associated with the pair of the plug terminals 24 to be short-circuited with each other causes the associated operating piece 28 in the retainer 12 to be upwardly shifted against its own resiliency in contact with the riser 41'' and, finally, the contact areas 34*a* and 35*a* of the contact bridge 13 are consequently brought into contact with that pair of the plug terminals 24 thereby to electrically connect them together as shown in FIG. 8(B).

Figure 9A:
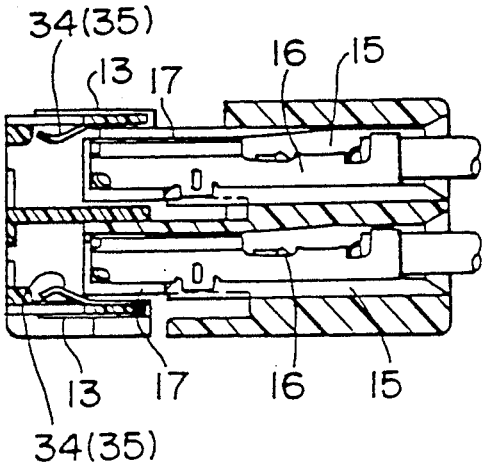
FIGS. 9(A) and 9(B) are longitudinal sectional views of the plug-in connector assembly, showing the retainer held in a temporary mounted position and a completely mounted position, respectively, according to a modified form of the present invention.
Figure 9B:
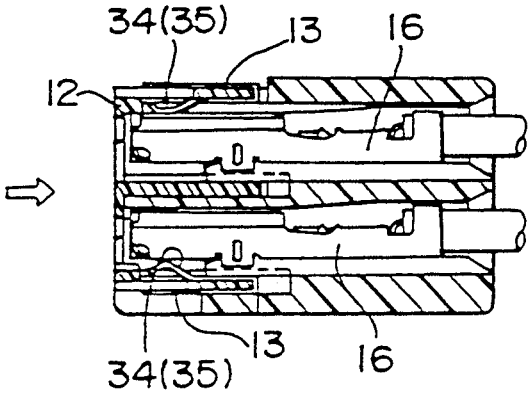
Figure 10:
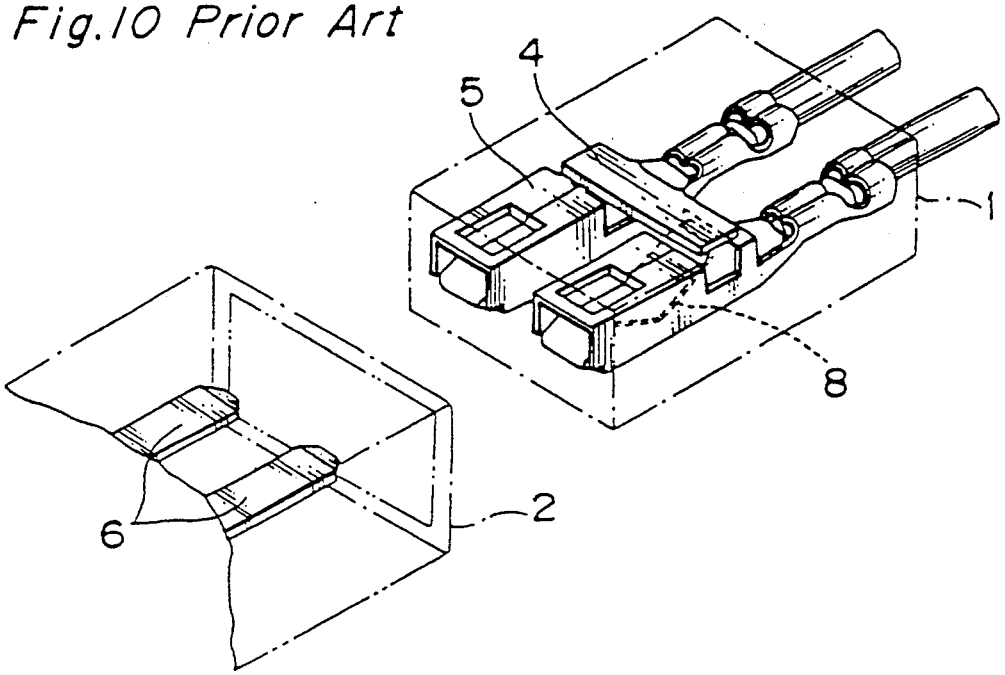
Fig.10 Prior Art
FIGS. 10 and 11 are schematic perspective views of the prior art plug-in connector assemblies.
Figure 11:
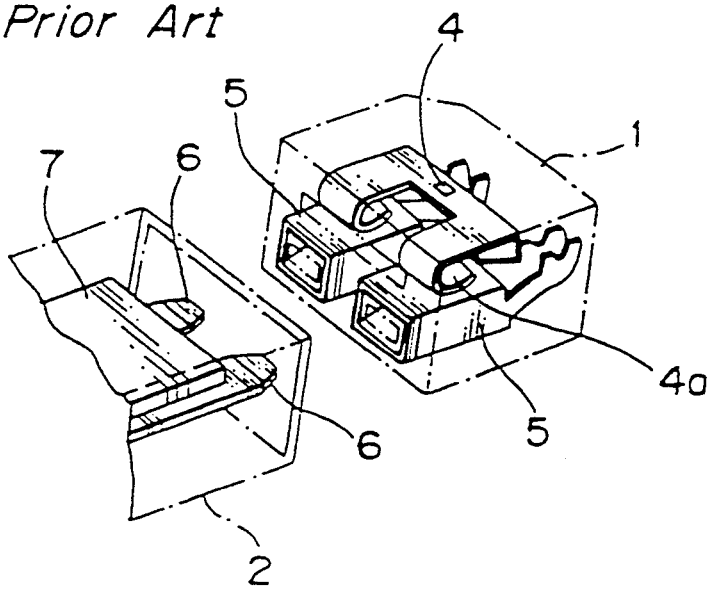
Fig. 11 Prior Art

It has been described that the three pairs of the passageways 15 in the upper row are used to accommodate the corresponding pairs of the socket, terminals 16 which are electrically short-circuited by means of the respective contact bridges 13 while one pair of the passageways 15 in the lower row are left blank, but are to accommodate a corresponding pair of the plug terminals 24 which are to be short-circuited with each other by means of the associated contact bridge 13 when the plug connector and the socket connector are coupled together. However, in the practice of the present invention, that one pair of the passageways 15 in the lower row may accommodate a corresponding pair of the socket terminals which are short-circuited by the contact bridge, but are isolated from each other when the socket and plug connectors are coupled together as shown in FIGS. 9(A) and 9(B). In the modification so far shown in FIG. 9, when the socket connector is inserted into the receptacle recess 40 in the plug housing 11, the upper and lower operating pieces carrying the respective contact bridges 13 are shifted outwardly so as to diverge outwardly with respect to the direction of insertion thereby to disengage from the associated pairs of the socket terminals in the upper and lower rows, respectively. This can be accomplished by employing an actuator rib similar to the actuator rib 41 in the plug housing 11 in association with the lower pair of the socket terminals in the socket housing.

From the above description of the preferred embodiment of the present invention, it is clear that, since in assembling the socket connector the retainer 12 carrying the contact bridges 13 is held at the temporary mounting position with the contact areas 34*a* and 35*a* of each contact bridge 13 held clear from the associated passageways 15, the socket terminals 16 can be smoothly inserted into the respective passageways without receiving any resistance which would otherwise be imposed by the contact areas 34*a* and 35*a* if the latter protrude through the access openings 17 into the respective passageways 15. It is also clear that, as the socket connector, i.e., the socket housing 10 having the retainer 12 completely mounted thereon, is inserted into the receptacle recess 40 in the plug housing 11, the operating pieces 28 carrying the respective contact bridges 13 then short-circuiting the pairs of the socket terminals 16 in the upper row and the operating piece 28 carrying the contact bridge 13 intended to short-circuit the pair of the plug terminals 24 are shifted against their own resiliency to cause the contact areas 34*a* and 35*a* to disengage from the associated socket terminals 16 and to bring the contact areas 34*a* and 35*a* into engagement with the pair of the plug terminals 24, respectively.

It is also clear that the formation of the retainer carrying the contact bridges does not require the use of any insert-molding technique and can readily be accomplished merely by clipping at least one or a required number of contact bridges onto the retainer. It is to be noted that the contact bridges may be provided for all available pairs of the passageways in one or a plurality of rows in the socket housing so that the user of the plug-in connector assembly embodying the present invention can remove or mount only a required number of the contact bridges on the retainer to suit to a circuit specification to which the user refers.

Although the present invention has been described in connection with the preferred embodiment thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. A connector assembly comprising:

a connector housing having an end portion and also wall portions defining a plurality of passageways for accommodating therein terminal members;

a retainer mounted on the end portion of the connector housing for movement between a temporary mounting position and a completely mounted position for detecting an erroneous insertion of at least one of the terminal members into the associated passageway;

means for temporarily holding the retainer at the temporary mounting position on the end portion of the connector housing; and at least one contact bridge member mounted on the retainer, at least one pair of the terminal members being short-circuited with each other by means of the contact bridge member when the terminal members have been inserted into the passageways and the retainer is subsequently moved from the temporary mounting position to the completely mounted position.

2. The connector assembly as claimed in claim 1, wherein the wall portions of the connector housing, which define the passageways for accommodating said at least one pair of the terminal members, are formed with respective access openings, and wherein said contact bridge member includes contact areas which are brought into engagement with said at least one pair of the terminal members through the respective access openings when the retainer is moved to the completely mounted position.

3. The connector assembly as claimed in claim 1, further comprising a mating connector housing adapted to be coupled with the connector housing, said mating connector housing having a rib formed therewith so as to confront the connector housing, and wherein said connector housing has an end wall formed with an opening through which said rib protrudes, said contact bridge member being actuated by said rib, when the connector housing and the mating connector housing are coupled together, thereby to disengage from said at least one pair of the terminal members to open a circuit between said at least one pair of the terminal members.

4. The connector assembly as claimed in claim 2, further comprising a mating connector housing adapted to be coupled with the connector housing, said mating connector housing having a rib formed therewith so as to confront the connector housing, and wherein said connector housing has an end wall formed with an opening through which said rib protrudes, said contact bridge member being actuated by said rib, when the connector housing and the mating connector housing are coupled together, thereby to disengage from said at least one pair of the terminal members to open a circuit between said at least one pair of the terminal members.

5. The connector assembly as claimed in claim 3, wherein said mating connector housing has at least two terminal members, said terminal members of said mating connector housing being short-circuited with each other by means of the contact bridge member when the bridge member is actuated by said rib.

6. The connector assembly as claimed in claim 4, wherein said mating connector housing has at least two terminal members, said terminal members of said mating connector housing being short-circuited with each other by means of the contact bridge member when the bridge member is actuated by said rib.

7. An electric connector assembly comprising:

a first connector housing having an end portion and also having parallel passageways defined therein so as to open outwardly from the end portion thereof, each of said passageways accommodating therein a first terminal member;

a retainer adapted to be releasably mounted on the end portion of the first connector housing; and a first contact bridge member mounted on said retainer and engageable with the first terminal members to establish an electric circuit between the first terminal members when the first terminal members have been inserted completely into the passageways and the retainer has been completely mounted on the end portion of the first connector housing;

wherein at least said end portion of the first connector housing is of a generally rectangular cross-sectional shape and said retainer is of a generally cap-like configuration having a cross-section oversized relative to the end portion of the first connector housing to permit the retainer to be capped onto the end portion, and further comprising means for temporarily holding the retainer at a temporary mounting position on the end portion.

8. The connector assembly as claimed in claim 7, further comprising a second connector housing having a receptacle defined therein for receiving the end portion of the first connector housing, and also having at least two second electric terminal members partly protruding into the receptacle, said second connector housing having an actuator member operable in response to an insertion of the end portion of the first connector housing into the receptacle in the second connector housing to disengage the first contact bridge member from the first terminal members thereby to open an electric circuit between the first terminal members.

9. The connector assembly as claimed in claim 8, wherein said second terminal members in the second connector housing are electrically connected with the first terminal members in the first connector housing, respectively, when the end portion of the first connector housing is inserted into the receptacle to connect the first and second connector housings together.

10. The connector assembly as claimed in claim 8, wherein said second connector housing has at least two third terminal members partly protruding into the receptacle, and further comprising a second contact bridge member mounted on the retainer and a second actuator member carried by the second connector housing, said second actuator member driving the second contact bridge member to engage the third terminal members to establish an electric circuit between the third terminal members when the first and second connector housings are coupled together with the end portion inserted into the receptacle.

11. A connector assembly comprising:

a connector housing having a plurality of passageways for accommodating therein terminal members;

a retainer mounted on the connector housing for movement between a temporary mounting position and a completely mounted position for detecting an erroneous insertion of at least one of the terminal members into the associated passageway;

at least one contact bridge member mounted on the retainer, at least one pair of the terminal members being short-circuited with each other by means of the contact bridge member when the terminal members have been inserted into the passageways and the retainer is subsequently moved from the temporary mounting position to the completely mounted position; and a mating connector housing adapted to be coupled with the connector housing, said mating connector housing having a rib formed therewith so as to confront the connector housing, and wherein said connector housing has an end wall formed with an opening through which said rib protrudes, said contact bridge member being actuated by said rib, when the connector housing and the mating connector housing are coupled together, thereby to disengage from said at least one pair of the terminal members to open a circuit between said at least one pair of the terminal members, and wherein said mating connector housing has at least two terminal members, said terminal members of said mating connector housing being short-circuited with each other by means of the contact bridge member when the bridge member is actuated by said rib.

12. A connector assembly comprising:

a connector housing having wall portions defining a plurality of passageways for accommodating therein terminal members;

a retainer mounted on the connector housing for movement between a temporary mounting position and a completely mounted position for detecting an erroneous insertion of at least one of the terminal members into the associated passageway; and at least one contact bridge member mounted on the retainer, at least one pair of the terminal members being short-circuited with each other by means of the contact bridge member when the terminal members have been inserted into the passageways and the retainer is subsequently moved from the temporary mounting position to the completely mounted position, wherein the wall portions of the connector housing, which define the passageways for accommodating said at least one pair of the terminal members, are formed with respective access openings, and wherein said contact bridge member includes contact areas which are brought into engagement with said at least one pair of the terminal members through the respective access openings when the retainer is moved to the completely mounted position; and the connector assembly further comprising a mating connector housing adapted to be coupled with the connector housing, said mating connector housing having a rib formed therewith so as to confront the connector housing, and wherein said connector housing has an end wall formed with an opening through which said rib protrudes, said contact bridge member being actuated by said rib, when the connector housing and the mating connector housing are coupled together, thereby to disengage from said at least one pair of the terminal members to open a circuit between said at least one pair of the terminal members, wherein said mating connector housing has at least two terminal members, said terminal members of said mating connector housing being short-circuited with each other by means of the contact bridge member when the bridge member is actuated by said rib.

13. An electric connector assembly comprising:

a first connector housing having an end portion and also having parallel passageways defined therein so as to open outwardly from the end portion thereof, each of said passageways accommodating therein a first terminal member;

a retainer adapted to be releasably mounted on the end portion of the first connector housing; and a first contact bridge member mounted on said retainer and engageable with the first terminal members to establish an electric circuit between the first terminal members when the first terminal members have been inserted completely into the passageways and the retainer has been completely mounted on the end portion of the first connector housing;

wherein at least said end portion of the first connector housing is of a generally rectangular cross-sectional shape and said retainer is of a generally cap-like configuration having a cross-section oversized relative to the end portion of the first connector housing to permit the retainer to be capped onto the end portion, and further comprising means for temporarily holding the retainer at a temporary mounting position on the end portion; the electric connector assembly further comprising a second connector housing having a receptacle defined therein for receiving the end portion of the first connector housing, and also having at least two second electric terminal members partly protruding into the receptacle, said second connector housing having an actuator member operable in response to an insertion of the end portion of the first connector housing into the receptacle in the second connector housing to disengage the first contact bridge member from the first terminal members thereby to open an electric circuit between the first terminal members, wherein said second connector housing has at least two third terminal members partly protruding into the receptacle, and further comprising a second contact bridge member mounted on the retainer and a second actuator member carried by the second connector housing, said second actuator member driving the second contact bridge member to engage the third terminal members to establish an electric circuit between the third terminal members when the first and second connector housings are coupled together with the end portion inserted into the receptacle.

* * * * *